US005297692A

United States Patent [19]

Kronmiller

[11] Patent Number: 5,297,692

[45] Date of Patent: Mar. 29, 1994

[54] COVER RETAINER MEANS

[76] Inventor: Leroy M. Kronmiller, 7568 Ridge Ave., Philadelphia, Pa. 18128

[21] Appl. No.: 991,563

[22] Filed: Dec. 16, 1992

[51] Int. Cl.[5] ..... B65D 45/08

[52] U.S. Cl. ..... 220/318; 292/258; 292/288

[58] Field of Search ..... 220/315, 318; 292/258, 292/288; 24/31 V, 32, 190, 194, 195, 196

[56] References Cited

U.S. PATENT DOCUMENTS 3,124,381 3/1964 Geldart ..... 292/258

3,893,725 7/1975 Coulter et al. ..... 292/258

4,241,846 12/1980 Murphy ..... 220/318

4,545,501 10/1985 DeFord ..... 220/318

*Primary Examiner*—Allan N. Shoap

*Assistant Examiner*—Nova Stucker

*Attorney, Agent, or Firm*—Frederick J. Olsson

[57] ABSTRACT

A barrel cover retainer in the form of a flexible band: end of the band is looped around one handle of the barrel; the band extends across the cover; and the opposite end of the band is looped around the other handle, folded back on itself, pulled taught, and held in place by hook and loop fastener means.

5 Claims, 1 Drawing Sheet

Fig- 1
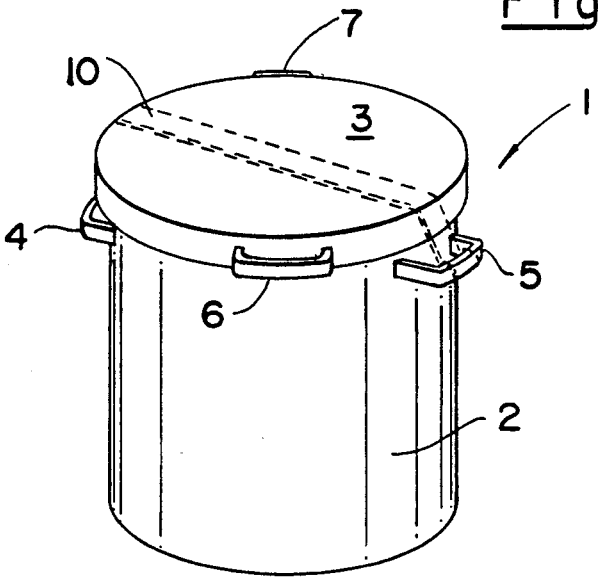
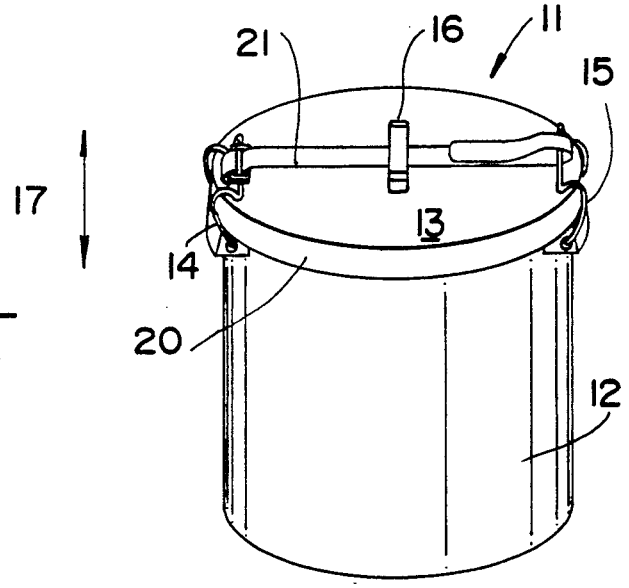
Fig- 2
Fig- 3
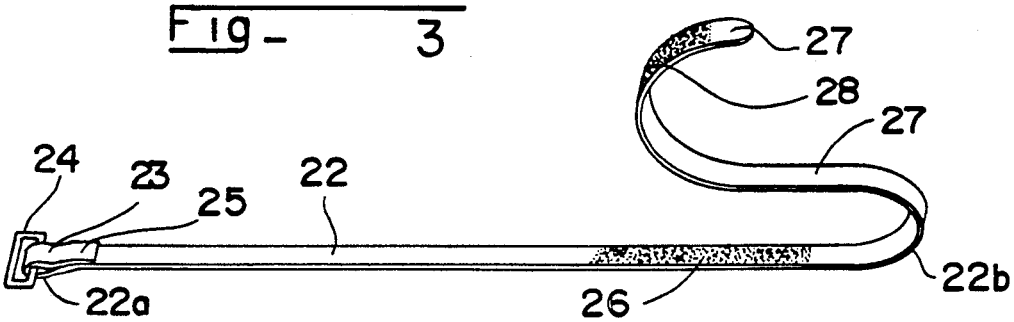

COVER RETAINER MEANS

This invention relates to the collection of trash or waste from covered barrels and especially relates to cover retainer means for holding the cover in place and thereby insuring that the trash remains captured pending pick-up.

One object of the invention is to provide barrel cover retainer in the form of a flexible hand which extends between the barrel handles over the barrel cover, one end being wrapped around one handle and held in position by an attaching ring and the other end being wrapped around the other handle and held in position by hook and loop means which provides for quick securing and quick release of the retainer.

Another object of the invention is to provide a cover retainer in the form of a flexible band one end of which is wrapped around one of the barrel handles and secured by an attaching ring so as to remain secured to the barrel during the time a cover is being removed or replaced and thereby avoid loss of the retainer.

Another object of the invention is to provide a cover retainer in the form of a flexible band having at one end and on the same surface, adjacent hook and loop self-gripping fastener sections which can, when the end of the band is threaded through one of the handles and folded back over the band be pressed together to provide for quick securing and quick release of the retainer.

Another object of the invention is to provide a retainer comprising a flexible band having an attaching ring on one end, the retainer being secured to one handle of a trash barrel by that the ring and end of the band are threaded through the handle, the other end of the band brought up and threaded through the ring to form a loop around the handle and then pulled to tight close the loop secure the retainer in position.

Another object of the invention is to provide a cover retainer of the kind is question which is of very simple construction and is very easy to manipulate so that no special skill or strength is required to place on or take off of a cover.

Another object of the invention is to provide a cover retainer of the kind in question which can be sold to the consumer at a low cost.

The invention will be described below in connection with the following drawings wherein:

FIG. 1 is a perspective view of the top of one type of conventional barrel with a cover in a closed position and the retainer of the invention holding the cover;

FIG. 2 is a perspective view of the top of another type conventional barrel with the cover in closed position and retainer of the invention holding the cover; and FIG. 3 is a perspective view of the retainer of the invention.

Referring to FIG. 1, I have shown the top part of a trash barrel assembly 1 comprising the barrel 2 and cover 3. The barrel and cover are conventionally molded from plastic material. The assembly 1 is of the type wherein the barrel 2 has a pair of fixed open handles 4 and 5 and the cover 3 has a pair of fixed open handles 6 and 7.

A retainer. 10 is shown connected to barrel handles 4 and 5, and extending over and in engagement with the cover 3.

As will be evident, the retainer 10 holds the cover in closed position that position retains the trash in the barrel pending pick-up.

Referring to FIG. 2 there is shown the top part of a trash barrel assembly 11 comprising a barrel 12 and cover 13. Like the assembly 1, the barrel 12 and cover 13 are made of molded plastic. The assembly 11 is of the type wherein the barrel 12 has a pair of open handles 14 and 15 and the cover 13 has a single open handle 16. Each handle 14 and 15 is pivotally mounted on the barrel to move in the direction of the arrows 17. Each handle is contoured so that when in the position shown is FIG. 2, it extends over and engages a ledge 20 formed on cover 13. In this position, the handles 14 and 15 are adapted to lock the cover 13 in place.

With respect to the locking function of handles 14 and 15, wear of the plastic at the pivot points and distortion of the cover 13 many times results in one or both of the handles 14 and 15 failing to remain in the cover-lock position.

As with the assembly of FIG. 1, a retainer 21 is connected to the handles 14 and 15 extends over the top of cover 13 and under handle 16.

Whether the retainer actually engages the cover 13 depends upon the contour and height of handles 14 and 15 above the cover 13.

The retainers 10 and 21 of identical construction and will be described in connection with FIG. 3.

The retainer includes an elongated band generally noted at 22. The band material may be the conventional woven fabric such as used for various type of straps, for example, as employed in trunk straps. Or the band may be a hook and loop tape such as sold under the trademark VELCRO by Velcro USA, Inc of Manchester, N.H. and as sold under the trademark ZIP-A-GRIP by Singer Company of Newark, N.J.

In any of the foregoing arrangements, the band should be flexible for easy handling and manipulation. It is preferred that the band material be made and plastic which is strong a climate resisting.

One end **22*a* the band 22 carries a closed loop 23 retaining an attaching ring 24. The assembly is formed by threading the end of the band thru the ring 24 folding back on the band, and joining the same of 25**.

Where the band 22 is made of fabric, the joining may be accomplished by stitching and where the band is plastic the joining may be done by welding. In either case, an appropriate conventional adhesive may be employed. Preferably, the attaching ring 24 is molded from plastic.

In FIG. 3 the loop 23 is rather enlarged. This is done simply for illustration purposes. Normally, the loop is substantially closed but with sufficient clearance so the ring 24 is loose in the sense that is can be moved and/or titled with respect to the loop.

The opposite end **22*b* of the band carries Velcro or Zip-a-Grip loop section 26. An extension 27 of the band carries VELCRO or ZIP-TO-GRIP hook section 28**.

Where the band 22 is formed of fabric both the Velcro loop section 26 and hook section 28 an preferably secured by stitching. Where the band 22 is of the tape type, it is preferable to use a Velcro or Zip-a Grip loop tape for the band 22, the section 26 is formed automatically, the section 28 is formed by a short piece of Velcro or Zip-a-Grip tape which may be welded to or stitched on the band. Making the band of Velcro loop tape is preferred because the loops are less likely to catch on clothing, gloves and the like.

The procedure for securing the retainer on the barrel cover will next be described.

With cover in closed position as shown in FIG. 1 the end 22*a* is threaded thru handle 4. The opposite end 22*b* is then brought up and threaded thru the attaching ring 24 which forms a loop around the handle. The band is then pulled to tightly close the loop. This secures the retainer to the barrel and avoids loss of the retainer.

The band is then brought across the top of the cover 3, (preferably under the handle 16 in the embodiment of FIG. 2) and the end 22*b* threaded through the handle 5. The end 22*b* and band are moved back around the handle and over the cover. This forms a partial closed loop around the handle. The band is pulled tightly while the end 22*b* is moved down so the hook and loop sections 26 and 28 engage. Thus, the retainer is secured in the handles which in turn secures the cover 3, 13 on the barrel.

For removing the cover 3, (say, to stash new trash) the end 22*b* is simply pull away to release the loop and hook sections and the band pulled toward the handle 4, and the retainer dropped to the side of the barrel. A similar procedure is used for securing the retainer 21 to the assembly in FIG. 2. Before closing, it is pointed out that the hook section is placed on the band so as to leave the top of the band free of loops as indicated at 29. This creates a pull tab for use in removing the retainer as described above.

I claim:

1. Retainer means of use in removably securing a trash barrel cover in place on a trash barrel of the type having at least one pair of oppositely disposed open handles which are adjacent the cover when the cover is in place, the retainer means comprising:

a flat, elongated band made of flexible material;

self-gripping fastener means disposed adjacent one end of said band, the self gripping fastener means comprising a hook section and a loop section each positioned on the same surface of the band, the band and the hook and loop section each being dimensioned to permit passage through one of said open handles for the purpose of the band forming a loop around the handle;

a closed loop formed on the opposite end of said band; and an attaching ring loosely mounted on said closed loop, the attaching ring being dimensioned to provide space for said band and said hook and loop sections to be passed through the attaching ring for the purpose of the band forming a loop around the other of said open handles.

2. The retainer of claim 1 wherein said hook and loop sections are arranged to create a pull tab on said one end of the band.

3. The retainer means of claim 1 wherein said loop section extends for the length of the band.

4. In combination:

a trash barrel and a cover mounted on the barrel;

a pair of open barrel handles secured to the barrel the handles being oppositely disposed with respect to one another and being adjacent said cover;

a flat, elongated band made of flexible material extending over and across said cover between said handles and one end of the band being formed with a closed loop;

an attaching ring loosely mounted on said closed loop;

said band extending through one of said open handles and through said attaching ring and being pulled tight so as to be tightly looped around the one open handle;

self-gripping fastener means disposed adjacent the opposite end of said band, the self-gripping fastener means comprising a hook section and a loop section each positioned on the same surface of the band; and said band extending through the other of said open handles, being pulled up tight on the other open handle and folded back and positioned so that said hook and loop sections engage.

5. The retainer of claim 4 wherein said hook section is arranged to create a pull tab on the end of the band.

* * * * *